US007191794B2

(12) United States Patent
Hodges

(10) Patent No.: US 7,191,794 B2
(45) Date of Patent: Mar. 20, 2007

(54) MIXING VALVE MOUNTING ASSEMBLY

(75) Inventor: B. Eugene Hodges, Greenville, MI (US)

(73) Assignee: James Bruno, Ada, MI (US)

( * ) Notice: Subject to any disclaimer, the term of this patent is extended or adjusted under 35 U.S.C. 154(b) by 349 days.

(21) Appl. No.: 10/605,798

(22) Filed: Oct. 28, 2003

(65) Prior Publication Data

US 2004/0103941 A1 Jun. 3, 2004

Related U.S. Application Data

(60) Provisional application No. 60/319,721, filed on Nov. 22, 2002, provisional application No. 60/319,662, filed on Oct. 31, 2002.

(51) Int. Cl.
*F16L 5/00* (2006.01)

(52) U.S. Cl. ..... 137/360; 137/343; 137/357; 4/695; 248/56; 248/65; 248/74.4

(58) Field of Classification Search ..... 137/360, 137/357, 343; 4/675, 695; 248/65, 74.1–74.4, 248/56

See application file for complete search history.

(56) References Cited

U.S. PATENT DOCUMENTS

| | | | | |
|---|---|---|---|---|
| 3,556,130 | A * | 1/1971 | King, Jr. | 137/343 |
| 4,896,381 | A | 1/1990 | Hutto | |
| 5,031,658 | A | 7/1991 | Brattoli | |
| 5,195,553 | A | 3/1993 | Wright | |
| 5,277,220 | A | 1/1994 | Thul | |
| 5,813,431 | A | 9/1998 | Cool et al. | |
| 5,845,673 | A | 12/1998 | Paul | |
| 6,178,981 | B1 | 1/2001 | Wales | |
| 6,421,849 | B1 * | 7/2002 | Gray | 4/675 |
| 6,422,520 | B1 | 7/2002 | Hand | |
| 2002/0108328 | A1 * | 8/2002 | Richardson | 52/220.8 |

* cited by examiner

*Primary Examiner*—Eric Keasel
*Assistant Examiner*—Craig Price

(57) ABSTRACT

An assembly for mounting a tub/shower mixing valve onto a fiberglass shower stall wall. The assembly comprises a valve mounting sleeve and a locking plate that helps secure the mounting sleeve to the shower stall wall. Alternatively, the mounting sleeve may be secured to the shower stall wall by bolts threadably connected to the mounting sleeve.

13 Claims, 7 Drawing Sheets

MIXING VALVE MOUNTING ASSEMBLY

BACKGROUND OF INVENTION

This patent relates to a mounting assembly for a tub/shower mixing valve. More particularly, this patent relates to an assembly for mounting a tub/shower mixing valve directly to a fiberglass shower wall.

Single handle mixing valves are used in place of two handle valves to mix hot and cold water before use in a shower, tub or basin. Single handle mixing valves typically are made of brass and have four ports, one each for the hot and cold water inlets, one for the shower pipe and one for the tub spout pipe. If the installation is for a shower only, then the tub filler port is capped.

Single handle mixing valves are not sold with any type of mounting bracket. Consequently, installing a mixing valve in a shower typically requires constructing a wooden frame to support the valve. The valve can be mounted directly to vertical wall studs or it can be supported between two studs by mounting it to a horizontal board placed between the studs. After the wooden supports are in place, the valve is mounted to the supports by using copper or plastic straps, a bent nail or other attachment means to secure the pipes to the supports.

Because mixing valves are not sold with mounting brackets, replacing an old mixing valve can be difficult, time consuming and expensive. Sometimes the only way to get at the old valve is through the wall behind the shower stall. Replacing the old valve can involve cutting an opening in the drywall in the adjacent room, cutting the pipes connected to the old valve, removing the old valve, and installing the replacement valve. Since there is no ready way to hold the replacement valve in place, a second person must stand in the shower stall holding the nose of the replacement valve while the first person stands in the adjacent room soldering the pipes to the water lines.

Thus it is an object of the present invention to provide an assembly for mounting a valve onto a tub/shower stall wall.

Another object of the invention is to provide a mounting assembly that eliminates the need to construct a support frame for a tub/shower mixing valve by providing a means for mounting the mixing valve directly to the shower stall wall.

Further and additional objects will appear from the description, accompanying drawings, and appended claims.

SUMMARY OF INVENTION

The present invention is a mounting assembly for a tub/shower mixing valve for use in installing a valve onto a fiberglass shower stall wall. The assembly comprises a valve mounting sleeve and a locking plate, and may be used to mount a mixing valve directly to the wall of a fiberglass shower stall. Alternatively, the mounting assembly comprises a valve mounting sleeve and bolts that secure the assembly to a shower stall wall.

DETAILED DESCRIPTION

The invention will now be described in terms of an assembly for mounting a mixing valve onto a fiberglass shower stall wall. It should be understood, however, that the invention also may be used with tub and shower stalls, and that the shower stall need not be fiberglass, but could be vinyl, metal, or any other suitable material of construction. Finally, it should be noted that the dimensions given in this specification are approximations and given for illustrative purposes only, and that the invention is not to be limited to any particular dimensions.

Figure 1:
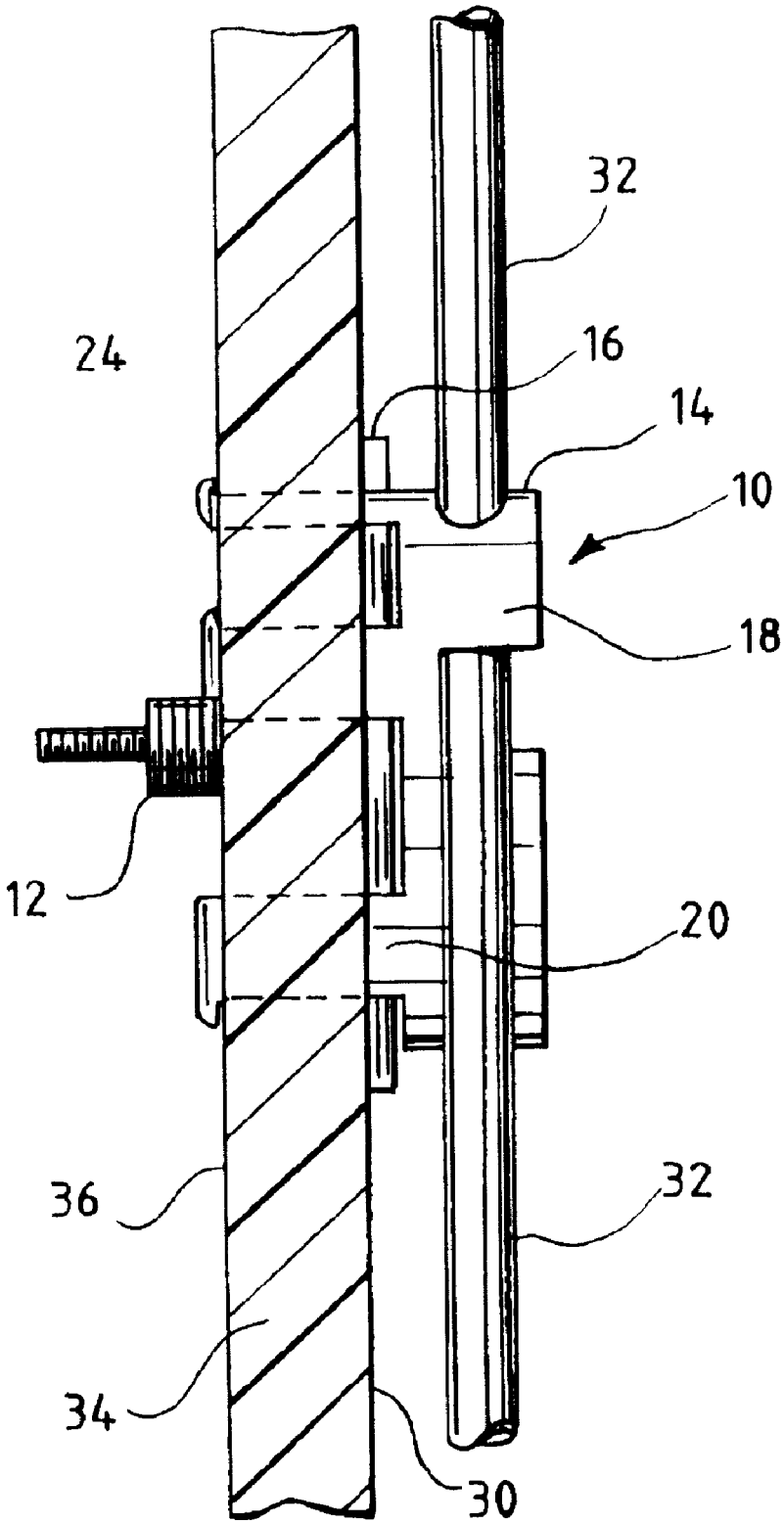
FIG. 1 is a side view of one embodiment of the mounting assembly according to the present invention, including the valve mounting sleeve and locking plate, shown installed onto a shower stall wall.

Turning to the drawings, there is shown in FIG. 1 one embodiment of the present invention, a mounting assembly 10 for a mixing valve 12, shown in side view installed onto a shower stall wall 34. The assembly 10 comprises a valve mounting sleeve 14 and a locking plate 16, and may be used to mount a mixing valve 12 directly to the wall of a fiberglass shower stall.

Figure 2:
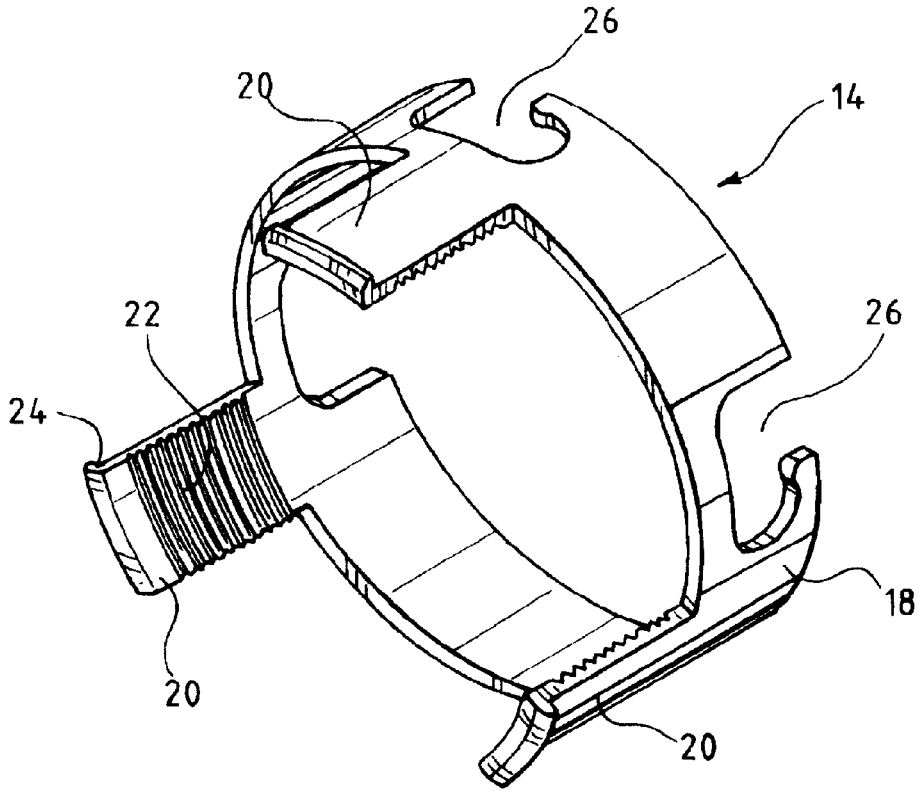
FIG. 2 is a perspective view of the valve mounting sleeve of FIG. 1.

As best shown in FIG. 2, the valve mounting sleeve 14 comprises a cylindrical portion 18 and a plurality of evenly spaced locking legs 20 extending forward (toward the tub) from one end of the cylindrical portion 18. Each locking leg 20 has inclined teeth 22 disposed on the inside of the leg 20 for holding the locking plate 16 against the backside of the shower stall wall 34 as further described below, and each leg 20 terminates in a radially outwardly extending flange 24. The legs 20 may be splayed outward so that they push against the sides of the opening in the shower stall wall 34 when the mounting sleeve 14 is installed. The mounting sleeve 14 can have three, four, or any suitable number of legs 20, although three legs 20 is preferred.

The cylindrical portion 18 of the sleeve 14 has a plurality of cutout sections 26 to accommodate the pipes 32 connected to the valve 12. The cutout sections 26 are generally L-shaped and may have a slight constriction where the width of the cutout section 26 is slightly less than the width of the pipes to hold the pipes 32 securely when the sleeve 14 installed. The sleeve 14 may be constructed of plastic or any other suitably resilient material.

Figure 3:
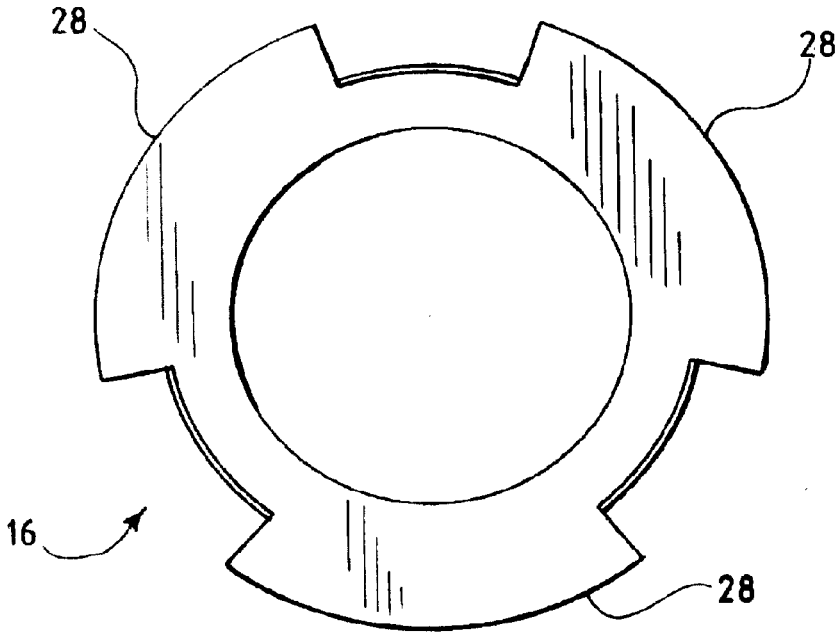
FIG. 3 is a top view of the locking plate of FIG. 1.
Figure 5:
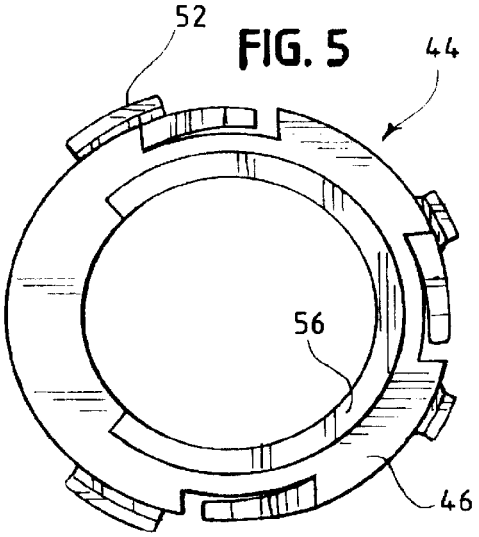
FIG. 5 is a bottom view of the valve mounting sleeve of FIG. 4.
Figure 4:
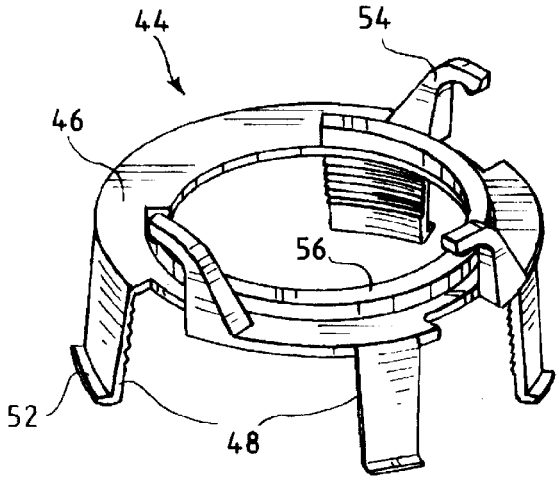
FIG. 4 is a perspective view of a second embodiment of the valve mounting sleeve.
Figure 6:
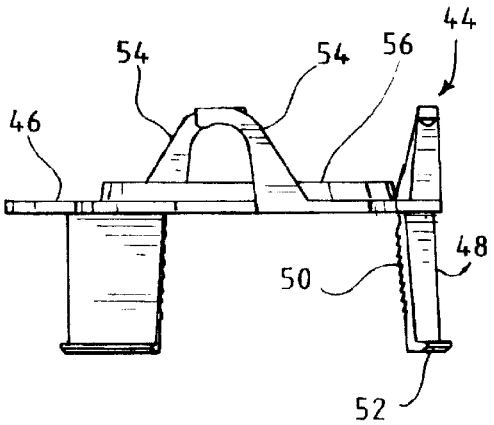
FIG. 6 is a side view of the valve mounting sleeve of FIG. 4.
Figure 7:
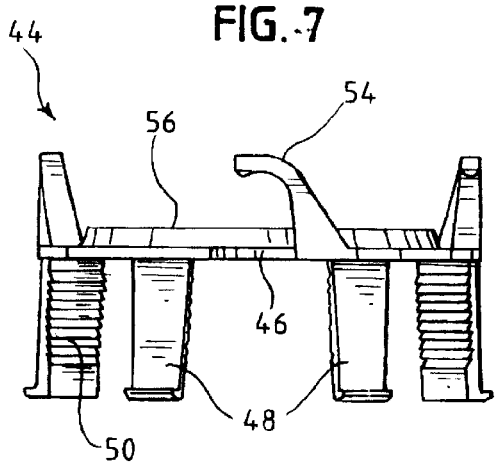
FIG. 7 is another side view of the valve mounting sleeve of FIG. 4.
Figure 8:
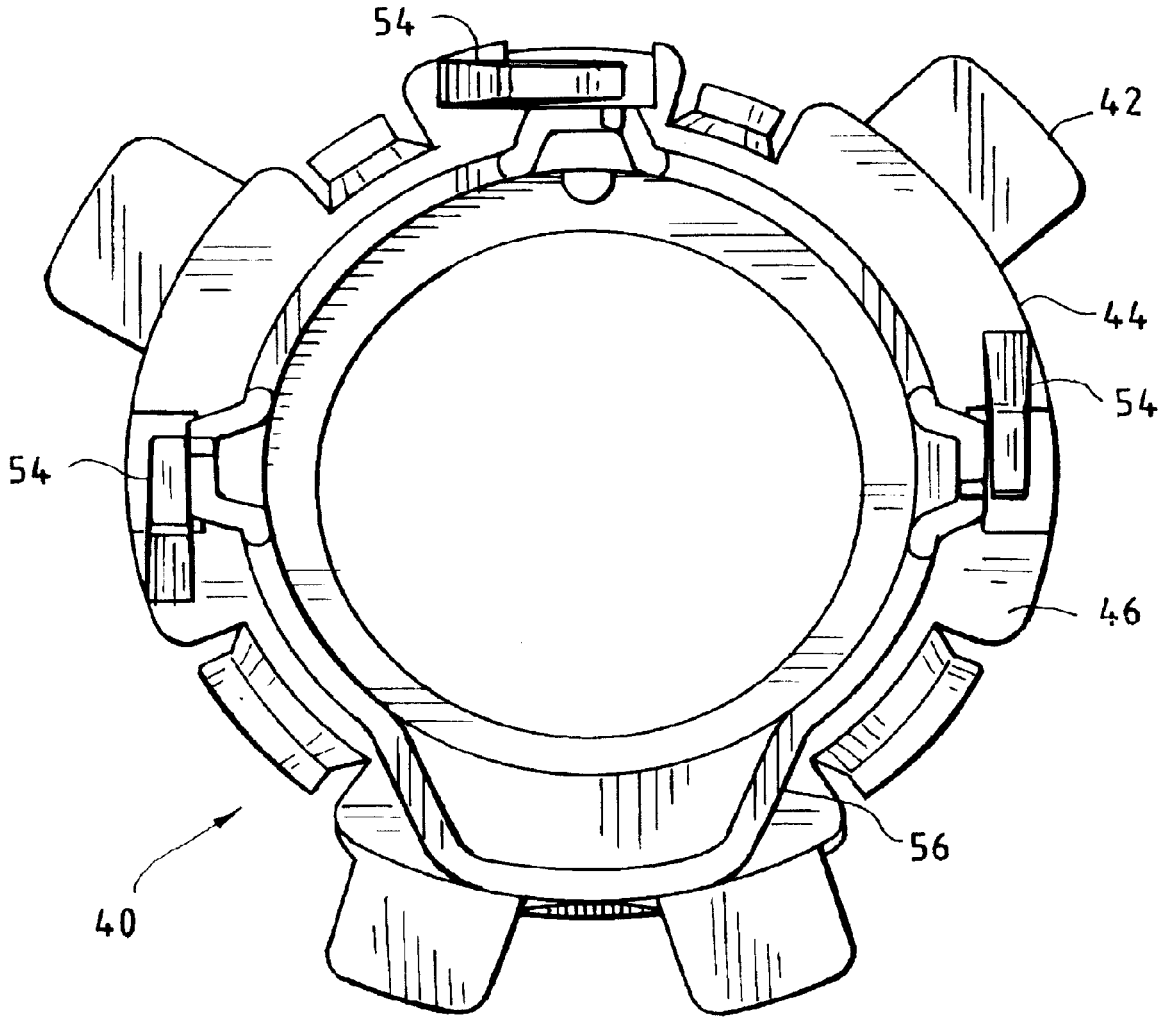
FIG. 8 is a top view of the second embodiment of the mounting assembly according to the present invention.

As shown in FIG. 3, the locking plate 16 is substantially planar and has a plurality of evenly spaced apart, radially extending sections 28 that, when installed, abut the rear (stud side) surface 30 of the shower stall wall 34. The locking plate 16 has a large circular aperture in its center for accommodating the mixing valve 12.

The invention is intended for use primarily with fiberglass shower stalls and tubs. Typically, the piping 32 will be pre-soldered onto the mixing valve 12. The piping 32 includes hot and cold inlet pipes, a shower pipe, and, if there is a tub spout, a tub spout pipe. The mounting assembly 10 typically will be provided with the locking plate 16 already held inside the mounting sleeve locking legs 20 by the inclined teeth 22.

The mounting assembly 10 is used in the following manner. To mount a mixing valve 12 to a shower stall wall 34, an opening, preferably about four and one-half inches in diameter, is cut into the shower stall wall 34 where the valve 12 will be located. The mounting sleeve 14 is twisted onto at least three of the pipes 32 such that the pipes 32 are captured by the cutout sections 26. Next, the two bottom locking legs 20 of the mounting sleeve 14 are set in place inside the opening in the shower wall 34. The top leg or legs 20 are bent radially inward with finger pressure so that the legs 20 fit inside the opening in the wall 34. The sleeve 14 is then tilted forward until the top legs 20 extend through the opening. When pressure on the top legs 20 is released, the legs 20 re-expand so that the leg flanges 24 abut the inner (tub facing) side 36 of the shower stall wall 34. Finally, the locking plate 16 is ratcheted forward until it abuts the rear surface 30 of the shower stall wall 34. The locking plate 16 and, in particular, the radially extending sections 28 of the locking plate 16, are held in place against the outer surface 30 of the shower stall wall 34 by the inclined teeth 22 on the inside of the locking legs 20. The valve 12 is now mounted securely to the shower stall wall 34.

FIGS. 4–10 show a second embodiment of a valve mounting assembly 40 according to the present invention. The assembly 40 comprises a mounting sleeve 44 and a locking plate 42. As shown in FIGS. 4–7, the mounting sleeve 44 comprises an annular ring portion 46 having a centrally disposed opening for accommodating the mixing valve 12 and a plurality of spaced apart locking legs 48 extending forward (toward the tub side of the wall 34) from the outer periphery of the annular ring 46. As with the first embodiment of the mounting sleeve 14, each locking leg 48 has inclined teeth 50 disposed on the inside of the leg 48 for holding the locking plate 42 against the backside of the shower stall wall 34 in ratchet fashion, and each leg 48 terminates in a radially outwardly extending flange 52. The legs 48 may be splayed outward so that they push against the sides of the opening in the shower stall wall 34 when the mounting sleeve 44 is installed. The mounting sleeve 44 can have three, four, or any suitable number of legs 48, although four legs is preferred.

Connected to the annular ring portion 46 is a plurality of rearward extending substantially L-shaped hook portions 54 for capturing the pipes 32 connected to the valve when the mounting sleeve 44 is twisted onto the pipes 32. The mounting sleeve 44 may have three, four or any suitable number of hook portions, although three is preferred. The hook portions are spaced around the perimeter of the annular ring 46 so that they capture the pipes 32 when the mounting sleeve 44 is installed. The hook portions preferably are located at the "three o'clock", "nine o'clock" and "twelve o'clock" positions when the mounting sleeve 44 is installed.

An upwardly extending rib 56 extends all or part way around the annular ring 46 on the stud side of the ring 46. The rib 56 helps to contain the pipes 32 by providing a surface against which the pipes 32 are held when they are captured by the hook portions 54. The rib 56 also helps stiffen the annular ring 46.

Figure 9:
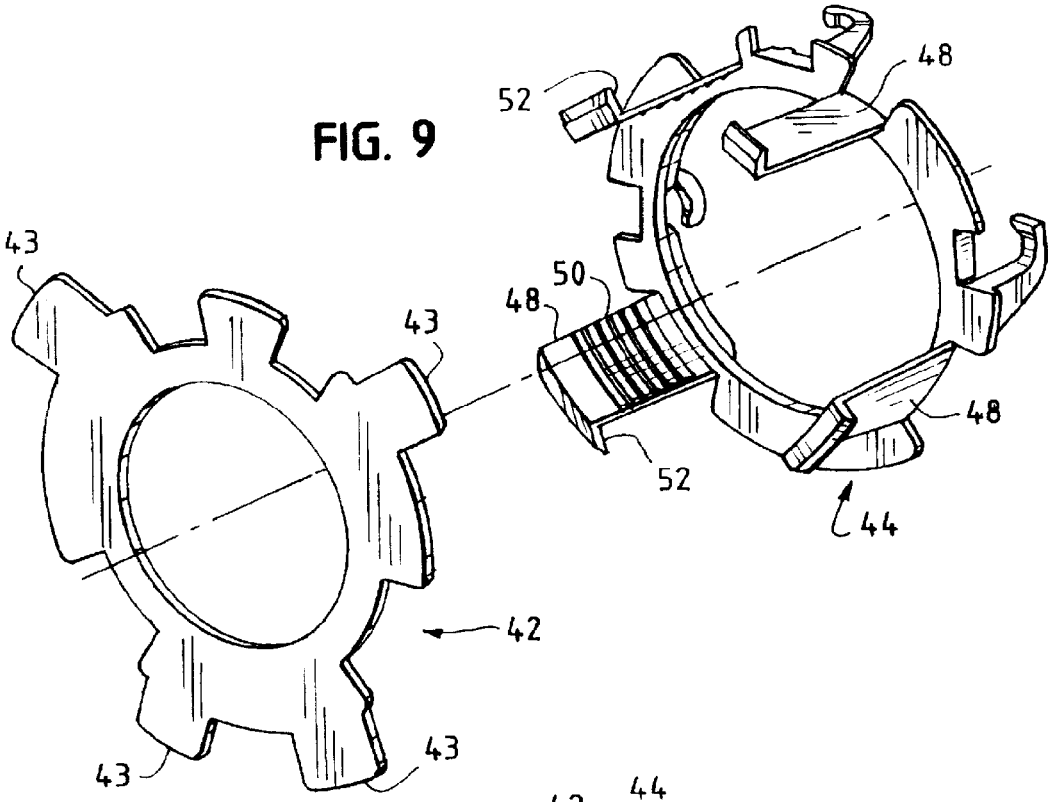
FIG. 9 is an exploded view of the mounting assembly of FIG. 8.
Figure 10:
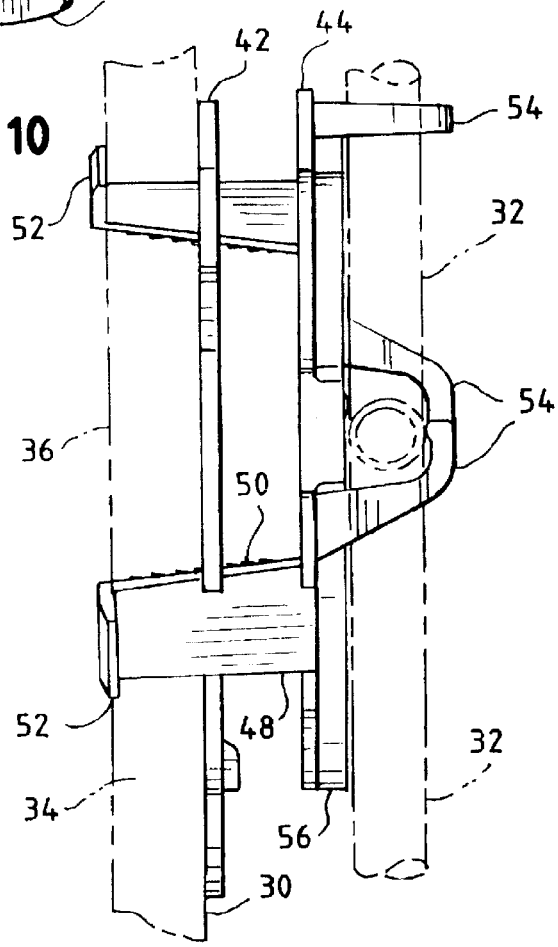
FIG. 10 is a side view of the mounting assembly of FIG. 8 shown installed onto a shower stall wall.

As shown in FIG. 9, the locking plate 42 is substantially planar and has a centrally disposed opening for accommodating the mixing valve 12 and a plurality of evenly spaced apart, outwardly radially extending sections 43 that, when installed, abut the rear (stud side) surface 30 of the shower stall wall 34.

To install the mounting assembly 40, an opening, preferably about four and one-half inches in diameter, is cut into the shower stall wall 34 where the valve 12 will be located. The mounting sleeve 44 (with mounting plate 42 cradled inside the legs 48 adjacent the annular ring 46 and oriented with the legs 48 extending toward the tub or shower) is twisted (rotated) onto at least three of the pipes 32 such that the pipes 32 are captured by the hook portions 54. Typically, the horizontal hot and cold water lines are captured by the hook portions 54 located at the "three o-clock" and "nine o-clock" positions in FIG. 8 and the vertical shower line is captured by a third hook portion 54 perpendicular to the other two hook portions 54 and located at the "twelve o-clock" position in FIG. 8. Next, the two bottom locking legs 48 of the mounting sleeve 44 are set in place inside the opening in the shower wall 34. The top leg or legs 48 are bent radially inward with finger pressure so that the legs 48 fit inside the opening in the wall 34. The sleeve 44 is then tilted forward until the top legs 48 extend through the opening. When pressure on the legs top 48 is released, the legs 48 re-expand so that the leg flanges 52 abut the inner (tub facing) side 36 of the shower stall wall 34. Finally, the locking plate 42 is ratcheted forward until it abuts the rear surface 30 of the shower stall wall 34. The locking plate 42 and, in particular, the radially extending sections 43 of the locking plate 42, are held in place against the rear surface 30 of the shower stall wall 34 by the inclined teeth 50 on the inside of the locking legs 48. The valve (not shown in FIG. 10) is now mounted securely to the shower stall wall 34.

The two mounting assembly embodiments 10, 40 thus far described are likely to be useful with the majority of mixing valves, where the approximate width of the mixing valve is a standard 4½ inches. However, some mixing valves have a wider span due to, among other reasons, the existence of screwdriver stops on either side of the valve, the purpose of which is to enable a person to shut off the hot or cold source water at the valve. Accordingly, the mounting valve assemblies 10, 40 may be larger (wider) or at least elongated in either the horizontal or vertical direction to accommodate larger mixing valves.

Figure 11:
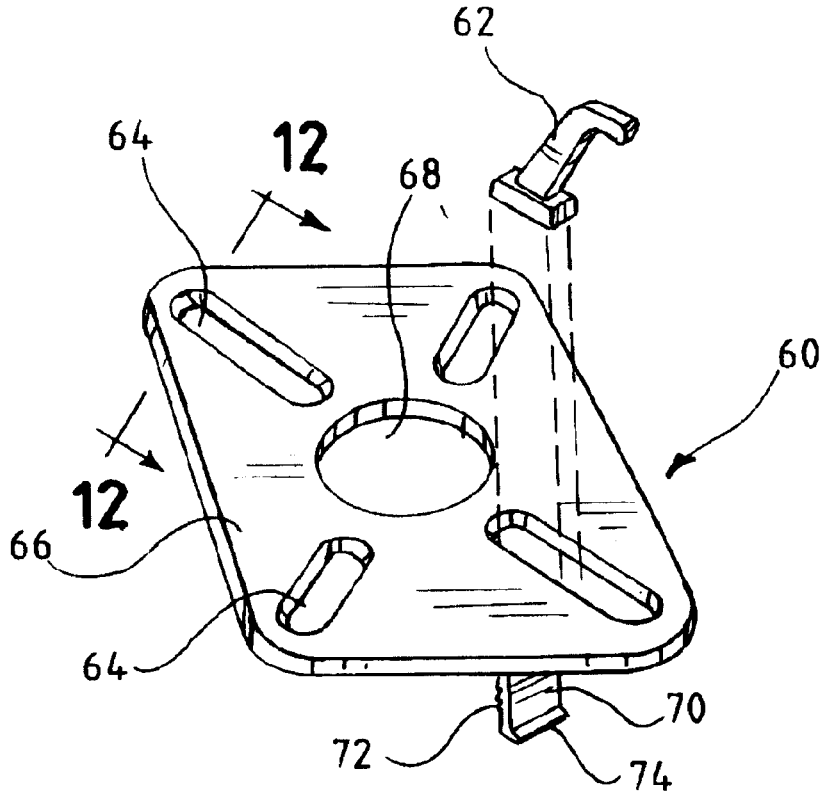
FIG. 11 is perspective view of a third embodiment of the valve mounting sleeve.
Figure 12:
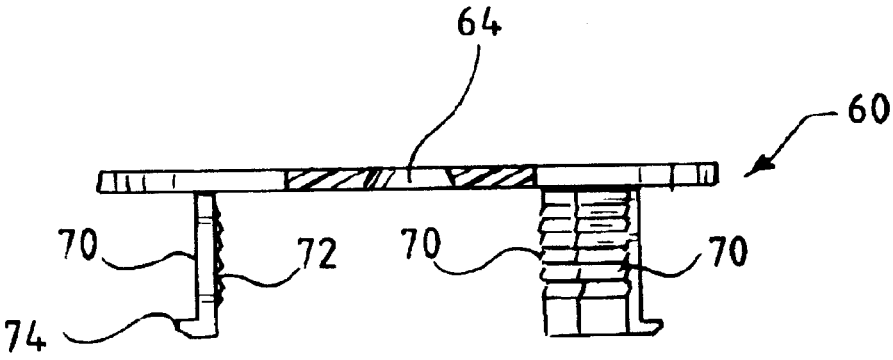
FIG. 12 is a cross-sectional view of the valve mounting sleeve of FIG. 11 taken along line 12—12.

It may also be useful to have a mounting sleeve in which the hook portions can travel to accommodate varying valve sizes. To that end, a third embodiment 60 of a mounting sleeve has been provided as shown in FIGS. 11 and 12. The mounting sleeve 60 comprises a planar member 66 having a central opening 68 through which the mixing valve (not shown) extends and slots 64 radially aligned around the central opening 68 and within which hook portions 62 can slide or travel to accommodate valves of different dimensions. As in the second embodiment, an optional upwardly extending rib (not shown) can extend rearward (toward the studs) from the surface of the planar member 66 to help secure the pipes and to strengthen the mounting sleeve 60. This third embodiment 60 is used with a locking plate (not shown) similar to those uses in the two earlier embodiments.

As best shown in FIG. 12, the slots 64 preferably have a dovetail cross-sectional shape into which the base of the hook portions 62 will fit, although the slots can have a T-shaped cross-section or any other suitable shape. The base of the hook portions 62 should have a shape complementary to that of the cross-section of the slots 64.

A plurality of locking legs 70 (typically three or four) extend forward (toward the tub) from the underside of the planar member 66. As with the first two embodiments, each locking leg 70 has inclined teeth 72 disposed on the inside of the leg 70 for holding a locking plate against the backside (stud side) of the shower stall wall. Each leg 70 terminates in a radially outwardly extending flange 74 for gripping the tub side of the shower stall wall. The mounting sleeve 60 can have three, four, or any suitable number of legs 70.

Figure 13:
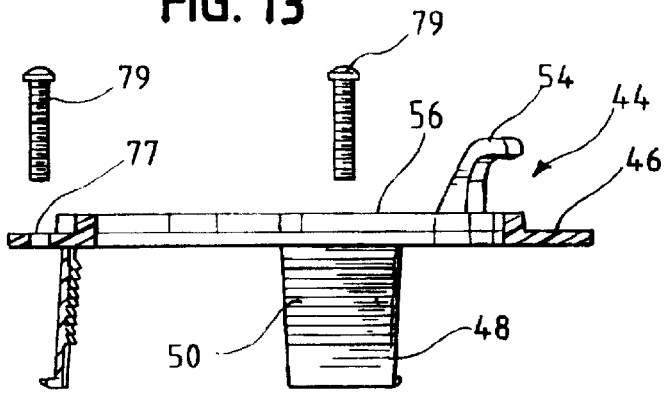
FIG. 13 is a cross-sectional view of the valve mounting sleeve of FIGS. 4–7, modified to accept bolts.
Figure 14:
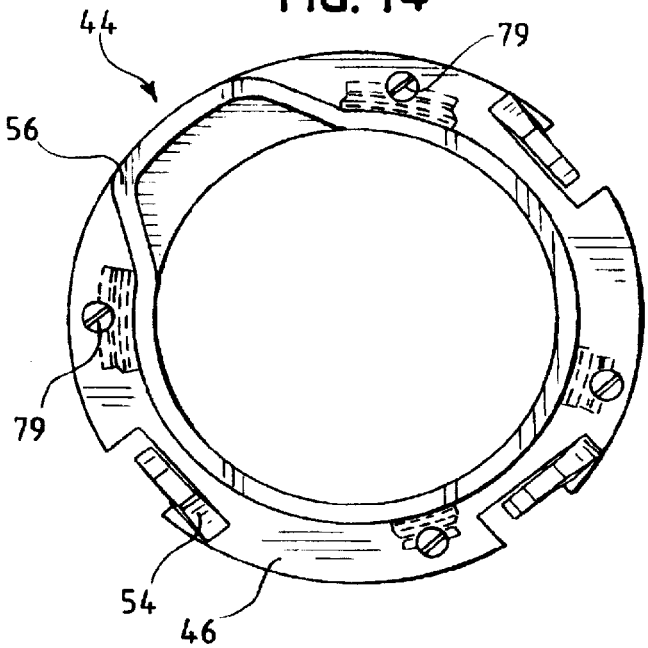
FIG. 14 is a top view of the modified valve mounting sleeve of FIG. 13 shown with bolts.
Figure 15:
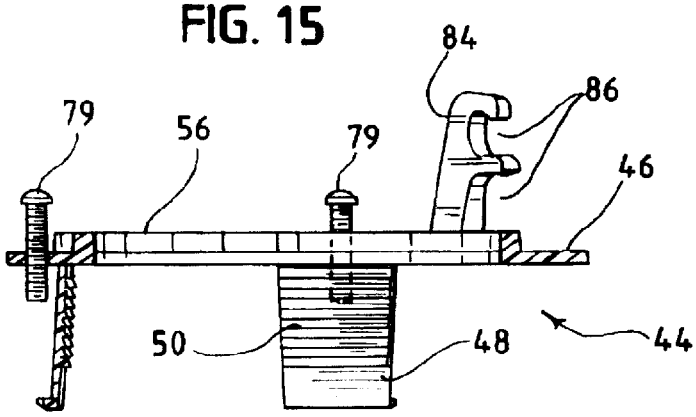
FIG. 15 is a cross-sectional view of the valve mounting sleeve of FIGS. 4–7, modified to accept bolts and having modified hook portions.

In yet another modification of the invention, bolts or screws 79 may be used to attach the mounting sleeve to the shower stall wall instead of a locking plate. Thus, as shown in FIGS. 13–14, the mounting sleeve 44 of FIGS. 4–7 may be modified to include threaded holes 77 disposed around the perimeter of the annular ring 46 for receiving bolts 79. As best shown in FIG. 15, the bolts 79 are threaded into the holes 77 until the ends of the bolts 79 abut the rear (stud facing) surface 30 of the shower stall wall 34 to secure the mounting sleeve 44 to the wall 34.

FIG. 15 shows still another possible modification of the invention wherein the hook portions 84 comprise multiple hook openings 86 (two in the illustrated embodiment, although any number of hook openings may be used) to accommodate pipes of varying distances from the shower stall wall. Alternatively, interchangeable hook portions can be provided with a single mounting sleeve so that the user can select the appropriate length hook portion depending on the distance between the pipes and the shower stall wall.

In still another possible modification, the openings in the hooks can be oriented at various angles with respect to the plane of the mounting sleeve, including perpendicular or parallel to the plane of the mounting sleeve, depending on how the valve is to be mounted.

Other modifications and alternative embodiments of the invention are contemplated which do not depart from the spirit and scope of the invention as defined by the foregoing teachings and appended claims. It is intended that the claims cover all such modifications that fall within their scope.

The invention claimed is:

1. The combination of a mixing valve, mounting assembly and shower stall wall, the mounting assembly comprising:

a) a mounting sleeve having an annular ring portion, a plurality of flexible locking legs extending forward from the periphery of the annular ring for insertion into and engagement with said shower stall wall, each leg having one-way ratchet means for holding a locking plate against a backside of said shower stall wall and terminating in a radially outwardly extending flange, and a plurality of rearward extending hook portions positioned to capture pipes connected to the mixing valve, and b) a substantially planar locking plate having radially extending sections that abut the backside of said shower stall wall when said locking plate is held against the backside of the shower stall wall by said one-way ratchet means.

2. The mounting assembly of claim 1 wherein said one-way ratchet means for holding the locking plate comprises inclined teeth disposed on the inside of each locking leg.

3. The mounting assembly of claim 1 wherein the hook portions are spaced around the perimeter of the annular ring.

4. The mounting assembly of claim 1 wherein the mounting sleeve further comprises a rearward extending rib disposed on the annular ring such that the pipes are captured between the hook portions and the rib.

5. The mounting assembly of claim 1 wherein the legs are splayed.

6. The mounting assembly of claim 1 wherein the hook portions travel within slots disposed in the mounting sleeve to accommodate valves of different dimensions.

7. The mounting assembly of claim 1 wherein the hook portions are detachable.

8. The mounting assembly of claim 7 comprising hook portions varying lengths.

9. The mounting assembly of claim 1 wherein the hook portions define multiple hook openings to accommodate pipes of varying distances from the shower stall wall.

10. The combination of a mixing valve, mounting assembly and shower stall wall, the mounting assembly comprising:

a) a cylindrical mounting sleeve having a plurality of flexible forwardly-extending locking legs, each of said locking legs being adapted to pass through and engage said opening and terminating in an outward-extending radial flange for overlying and gripping a front side of said shower stall wall, b) a substantially planar circular locking plate captured within said cylindrical mounting sleeve and having a central opening for receiving said mixing valve, said locking plate having a plurality of radially extending arc segments parallel to the backside of said shower stall wall and larger than said opening and cut-out sections for slidably receiving each of said locking legs, c) ratchet means on each locking leg for engaging a corresponding cut-out section of said locking plate for allowing one-way movement of said locking plate toward said shower stall wall, and d) said mounting sleeve having a plurality of rearward-extending hook elements for engaging, capturing and retaining supply pipes connected to said mixing valve.

11. The mounting assembly of claim 10 in which said ratchet means comprises inclined teeth pointing toward the back side of said shower stall wall.

12. The mounting assembly of claim 10 wherein said hook elements are spaced around the periphery of said mounting sleeve.

13. The mounting assembly of claim 10 wherein said mounting sleeve further comprises a rearward-extending rib interconnecting said hook elements such that said supply pipes are captured between the hook portions and the said rib.

* * * * *